US006402599B1

(12) United States Patent
Crevasse et al.

(10) Patent No.: US 6,402,599 B1
(45) Date of Patent: Jun. 11, 2002

(54) SLURRY RECIRCULATION SYSTEM FOR REDUCED SLURRY DRYING

(75) Inventors: Annette M. Crevasse, Apopka; William G. Easter, Orlando; John A. Maze, Clermont; Frank Miceli; Craig R. Zavilla, both of Orlando, all of FL (US)

(73) Assignee: Agere Systems Guardian Corp., Orlando, FL (US)

( * ) Notice: Subject to any disclaimer, the term of this patent is extended or adjusted under 35 U.S.C. 154(b) by 0 days.

(21) Appl. No.: 09/564,659

(22) Filed: May 3, 2000

(51) Int. Cl.[7] ..... B24C 3/20
(52) U.S. Cl. ..... 451/87; 451/88; 451/60; 451/446
(58) Field of Search ..... 451/87, 88, 60, 451/446

(56) References Cited

U.S. PATENT DOCUMENTS 2,774,679 A * 12/1956 Remer ..... 451/60
3,500,591 A * 3/1970 Gawronski et al. ..... 451/60
4,250,024 A * 2/1981 Soares et al. ..... 451/88
5,490,809 A * 2/1996 Jones et al. ..... 451/60
6,024,829 A * 2/2000 Easter et al. ..... 451/289
6,106,728 A * 8/2000 Iida et al. ..... 451/60
6,261,166 B1 * 7/2001 Asakawa et al. ..... 451/444

* cited by examiner

*Primary Examiner*—Joesph J. Hail, III
*Assistant Examiner*—Hadi Shakeri

(57) ABSTRACT

The present invention provides a slurry delivery system comprising a slurry conduit couplable to a wall of the slurry tank, and configured to receive a slurry therein and deliver a stream of the slurry against an inner wall of the slurry tank. Thus, the system inhibits drying of a slurry within the slurry tank and minimizes agglomeration on the sides of the slurry tank that results from slurry drying on the sides of the slurry tank's wall when the slurry level within the tank rises and falls. This minimization of agglomeration reduces the agglomerates within the slurry supply, which in turn, reduces the number of contaminants and scratches affecting the overall quality of the semiconductor wafer substrate.

29 Claims, 5 Drawing Sheets

SLURRY RECIRCULATION SYSTEM FOR REDUCED SLURRY DRYING

TECHNICAL FIELD OF THE INVENTION

The present invention is directed, in general, to a polishing system and, more specifically, to a slurry conduit that is couplable to a slurry day tank that reduces the amount of slurry that dries on the storage tank wall.

BACKGROUND OF THE INVENTION

In the manufacture of integrated circuits (ICs), chemical/mechanical polishing (CMP) is used to provide smooth topographies of semiconductor wafer substrates, on which the ICs are formed, for subsequent lithography and material deposition. These CMP processes are well known within the IC fabrication industry.

One problem area associated with chemical/mechanical polishing is in the area of slurry consistency. Because the polishing slurry is a suspension of a mechanical abrasive in a liquid chemical agent, e.g., an acid or base, the slurry has two undesirable tendencies that are common to suspensions: that is, settling/agglomeration, and evaporation of the chemical agent leaving a dried abrasive residue. To minimize the settling/agglomeration problem, the slurry is kept in constant circulation through a closed loop from a slurry supply tank (day tank) through a slurry pump and back into the slurry supply tank. The slurry loop is tapped with a tee and a valve so that a relatively small amount of slurry may be diverted to the polishing platen for CMP. The second problem, evaporation of the chemical agent, is aggravated by those conditions that allow the formation of a thin slurry layer, thereby increasing the slurry surface area per unit volume and increasing the rate of evaporation. This condition occurs commonly in the day tank above the current slurry level.

Referring initially to FIGS. 1A and 1B, illustrated are partial sectional views of one embodiment of a conventional CMP apparatus at the start of a planarizing process and after depletion of some slurry, respectively. A CMP apparatus, generally designated 100, comprises a polishing platen 110; first and second rotatable shafts 121, 122, respectively; a carrier head 130; a polishing pad 140 having a polishing surface 142; first and second drive motors 151, 152, respectively; and a slurry delivery system 160 containing slurry 161. The slurry delivery system 160 comprises a slurry tank 162, a slurry supply line 163, a slurry pump 164, and a slurry return line 165. Under pressure from the slurry pump 164, the slurry 161 circulates continuously in the slurry delivery system 160 from the slurry tank 162, through the slurry supply line 163, the slurry pump 164, the slurry return line 165 and back into the slurry tank 162 along a route designated by arrow 166. A portion 161a of the slurry 161 is diverted to the polishing surface 142 through a valve 167 while the remainder of the slurry 161 circulates to maintain the abrasive material in suspension.

A semiconductor wafer 170 is mounted in the carrier head 130 and is pressed against the polishing surface 142 that is wetted with slurry 161. The first and second rotatable shafts 121, 122 rotate the carrier head 130/semiconductor wafer 170 and platen 110, respectively, as shown, during CMP. One who is skilled in the art is familiar with the details of CMP as applied to semiconductor wafers.

As can be seen by comparing FIGS. 1A and 1B, a level 168*a*, 168*b* of the slurry 161 in the slurry tank 162 will vary during CMP processing. As the slurry level, collectively 168, varies, area 169 is subjected to alternating conditions of coverage with slurry 161 and exposure to ambient conditions. Therefore, the slurry 161 clings to the inner tank area 169 when the slurry level 168 falls to level 168*b* and the slurry 161 dries in that area 169. Exposed to the atmosphere, the chemical agent can readily evaporate, leaving behind a dried layer of abrasive. When dry, the slurry 161 may flake off of the vertical tank area 169 and fall back into the slurry 161 where the flakes remain until they are pumped to the polishing pad 140 and may come in contact with the semiconductor wafer 170, thereby causing damage. Because the dried slurry 161 retains its abrasive qualities and the dried slurry pieces are much larger than a design particle size for the slurry 161, these abrasive pieces must be substantially removed before the slurry 161 is deposited on the polishing pad 140 to avoid damaging features on the semiconductor wafer 170 being polished. It is impractical to control the slurry level 168 precisely in the day tank 162 because of the volume of the tank, e.g., 250 gallons or more total with fluctuations from a minimum of about 75 gallons to about 150 gallons, in order to avoid this problem.

To help alleviate this drying problem, one conventional approach has been to seal the day tank and to pump wet nitrogen, i.e., nitrogen bubbled through water, into the ullage. This approach was not particularly successful. Of course, frequent cleaning of the day tank has also be employed at considerable cost in time and manpower for fabrication system shutdown. Additionally, frequent handling of some slurries should be avoided because of safety concerns.

Accordingly, what is needed in the art is an improved slurry delivery system that minimizes the formation of dried slurry particles in the day tank and conserves time and manpower.

SUMMARY OF THE INVENTION

To address the above-discussed deficiencies of the prior art, the present invention provides a slurry delivery system comprising a slurry conduit couplable to a wall of the slurry tank and configured to receive a slurry therein and configured to deliver a stream of the slurry against an inner wall of the slurry tank.

Thus, in a broad scope, the present invention provides a system that inhibits drying of a slurry within the slurry tank that minimizes agglomeration on the sides of the slurry tank that results from slurry drying on the sides of the slurry tank's wall when the slurry level within the tank rises and falls. This minimization of agglomeration reduces the agglomerates within the slurry supply, which in turn, reduces the number of contaminants and scratches affecting the overall quality of the semiconductor wafer substrate.

In another embodiment, the slurry delivery system further comprises perforations in the slurry conduit configured to deliver the stream. In an additional aspect of this embodiment, the slurry delivery system further comprises nozzles coupled to the conduit at the perforations and configured to deliver the stream.

The slurry delivery system, in yet another embodiment, comprises a channel having outer and inner flanges. The outer flange has a height that is greater than the height of the inner flange whereby the inner flange forms a weir against the slurry. In a further aspect of this embodiment, a surface of the inner flange is contoured to transition smoothly to the inner wall.

The slurry conduit and the slurry tank, in another embodiment of the slurry delivery system, may be integrally formed. In yet another embodiment, the slurry conduit may comprise a plastic, such as polyvinyl alcohol. In a particularly advantageous embodiment, the slurry is a semiconductor wafer polishing slurry.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1A:
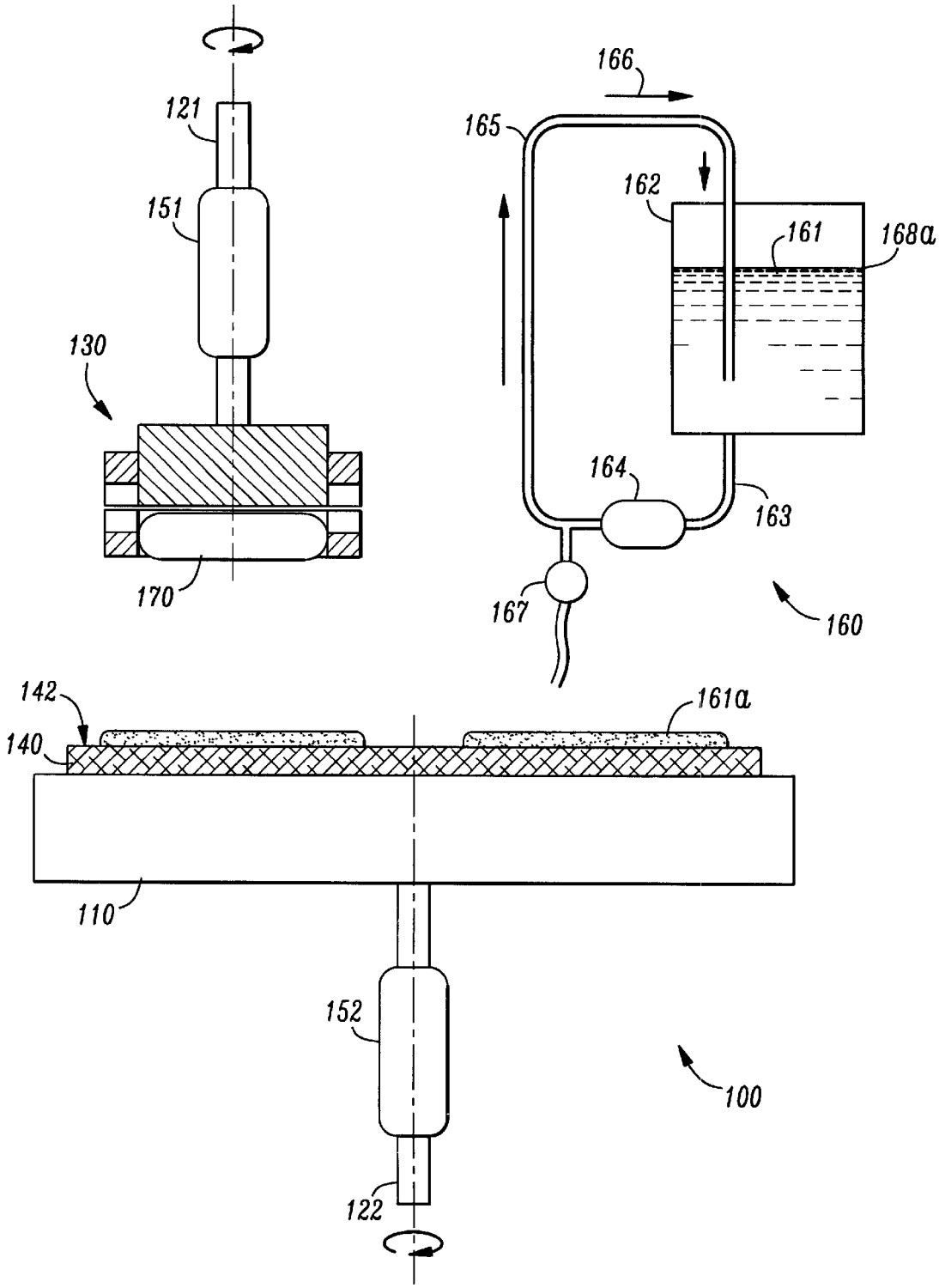
FIG. 1A (PRIOR ART)
FIG. 1A illustrates a partial sectional view of one embodiment of a conventional CMP apparatus at the start of a planarizing process.
Figure 1B:
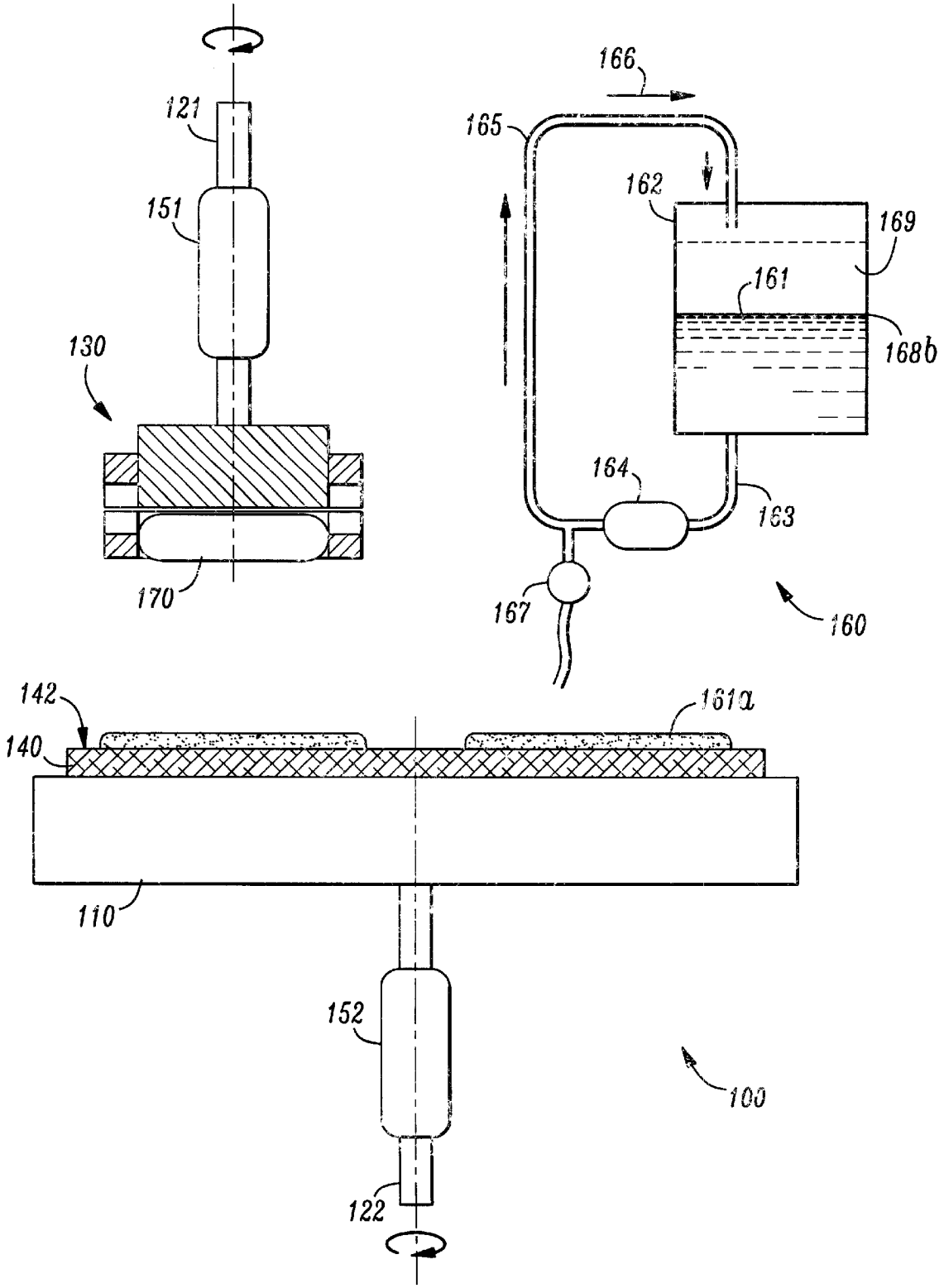
FIG. 1B (PRIOR ART)
FIG. 1B illustrates a partial sectional view of the conventional CMP apparatus of FIGURE. 1A after depletion of some slurry.
Figure 2A:
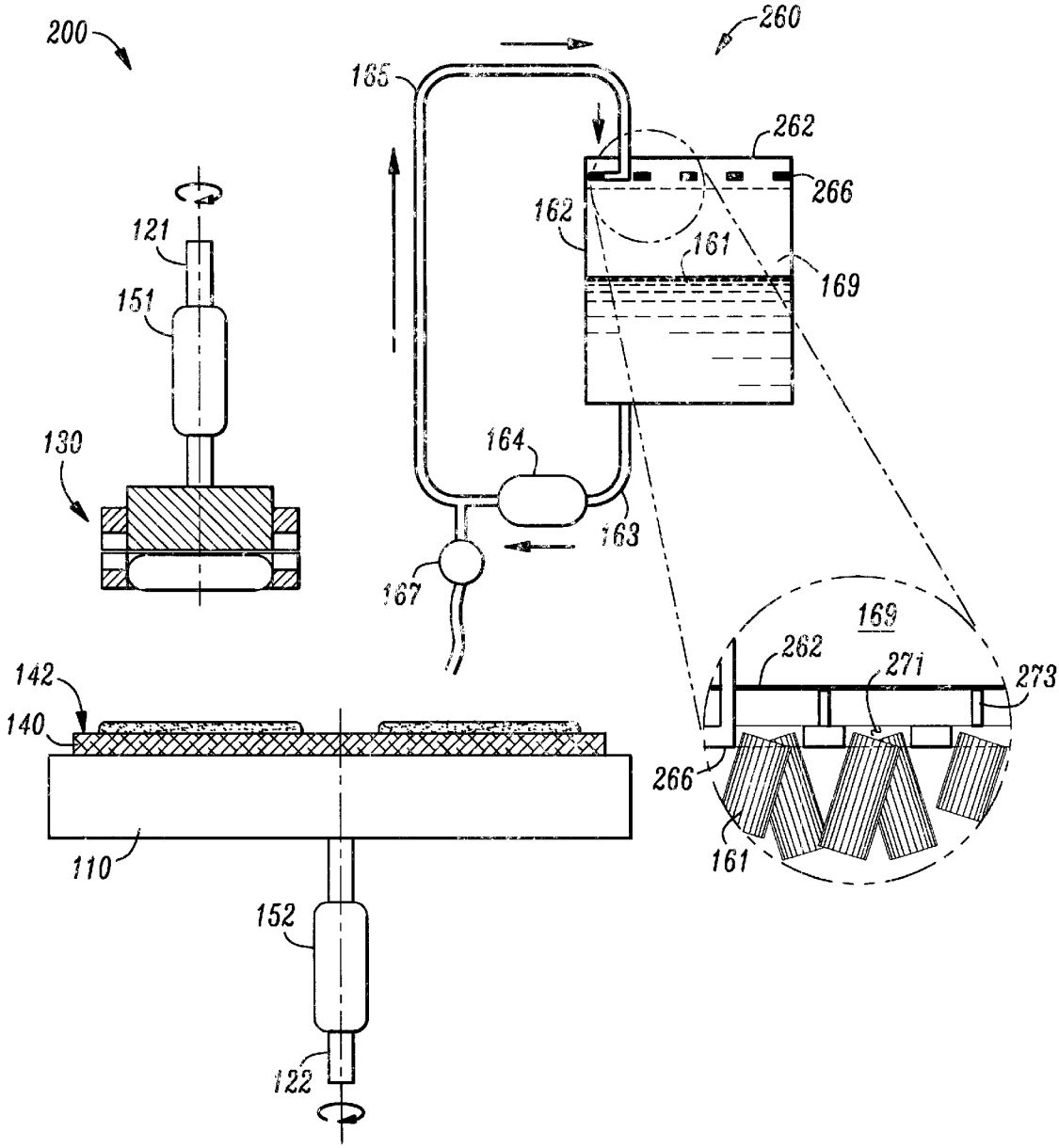
FIG. 2A illustrates a partial sectional view of one embodiment of a CMP apparatus constructed according to the principles of the present invention.
Figure 2B:
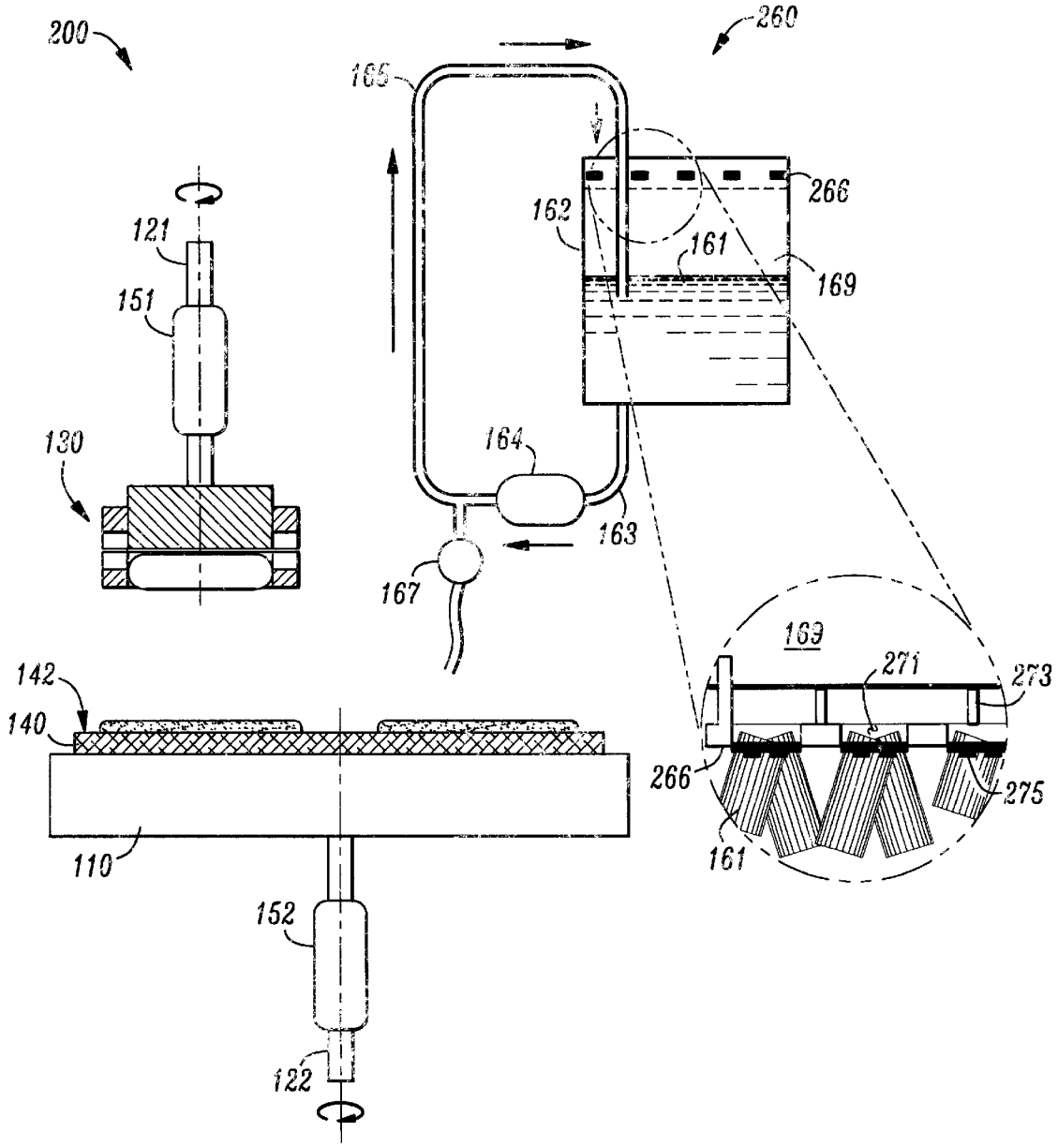
FIG. 2B illustrates the embodiment of FIG. 2A with the addition of nozzles at the perforations in the slurry conduit.

Referring now to FIGS. 2A and 2B, illustrated are partial sectional views of two embodiments of a CMP apparatus constructed according to the principles of the present invention. Similarly to that of FIGS. 1A and 1B, a CMP apparatus, generally designated 200, comprises the polishing platen 110; first and second rotatable shafts 121, 122, respectively; the carrier head 130; the polishing pad 140 having the polishing surface 142; first and second drive motors 151, 152, respectively; and a slurry delivery system 260 containing slurry 161. The slurry delivery system 260 comprises a slurry tank 162, a slurry supply line 163, a slurry pump 164, a slurry return line 165, and a slurry conduit 266, which is in fluid communication with the slurry return line 165.

In this embodiment, the slurry conduit 266 comprises a tube 266 having perforations 271 therein. The tube 266 may be coupled to the top 262 of the slurry tank 162 by clips 273 or other suitable methods. In one embodiment, the slurry conduit 266 may be formed of a plastic, such as polyvinylchloride (PVC) or synthetic resinousfluorine (TEFLON® or PVA). The perforations 271 are configured to spray slurry 161 on the inner surface 169 of the slurry tank 162 in a sheeting manner. By continuously spraying wet slurry 161 on the inner surface 169, the residue slurry 161, which accumulates on the inner surface 169 as the slurry level within the slurry tank 162 rises and falls, retains sufficient moisture to prevent evaporation and build up of agglomerate residue on the inner surface 169. The slurry 161 effectively forms a sheeting or bathing effect on the inner surface 169.

Referring now to FIG. 2B, illustrated is the embodiment of FIG. 2A with the addition of nozzles 275 at the perforations 271 in the slurry conduit 266. The nozzles 275 may be tuned for a particular slurry 161 to provide proper coverage of the inner surface 169. Of course, the orientation and size of the nozzles 275 are optimized for the distance from the surface 169. One who is skilled in the art of fluid dynamics is familiar with such designs.

Figure 3A:
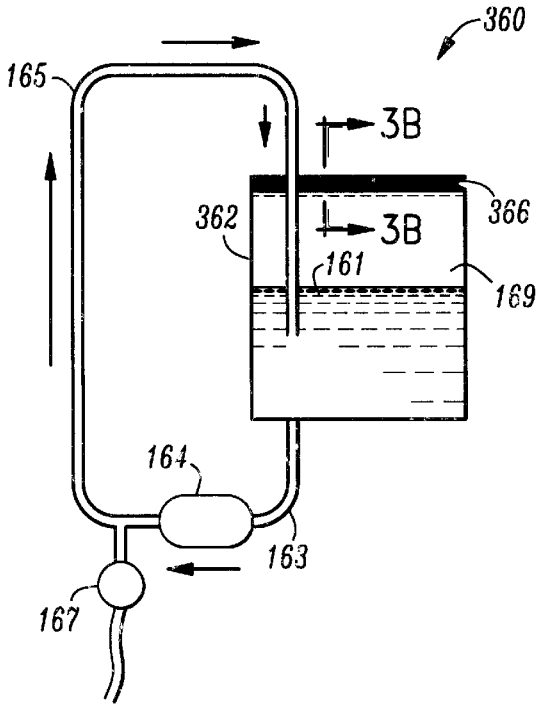
FIG. 3A illustrates a schematic view of an alternative embodiment of the slurry delivery system of FIG. 2A.
Figure 3B:
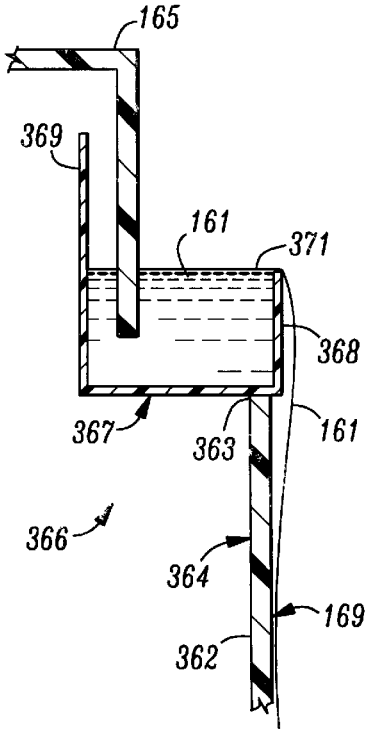
FIG. 3B illustrates a partial sectional view of the alternative embodiment of FIG. 3A.

Referring now to FIGS. 3A and 3B, illustrated are schematic and partial sectional views of an alternative embodiment of the slurry delivery system of FIG. 2A. In this embodiment, the slurry delivery system 360 comprises a slurry tank 362 and a slurry conduit 366. In one aspect, the slurry tank 362 and slurry conduit 366 may be integrally formed. Alternatively, the slurry conduit 366 may be formed separately and affixed to the top 363 of the slurry tank 362. In this embodiment, the slurry conduit 366 comprises a channel 367 having inner and outer flanges 368, 369, respectively. The outer flange 369 has a height that is greater than a height of the inner flange 368 so that slurry 161 being conveyed by the slurry return line 165 is prevented from flowing down the outside 364 of the slurry tank 362. The inner flange 368 is configured to act as a weir against which slurry 161 accumulates until a level 371 of the slurry 161 is. higher than the inner flange 368. At that time, slurry 161 flows essentially uniformly over the top of the inner flange 368 coating the inside 169 of the slurry tank 362. By maintaining a coating of liquid slurry 161, the slurry 161 is prevented from drying, thereby eliminating the flaking problems of prior art.

Figure 4A:
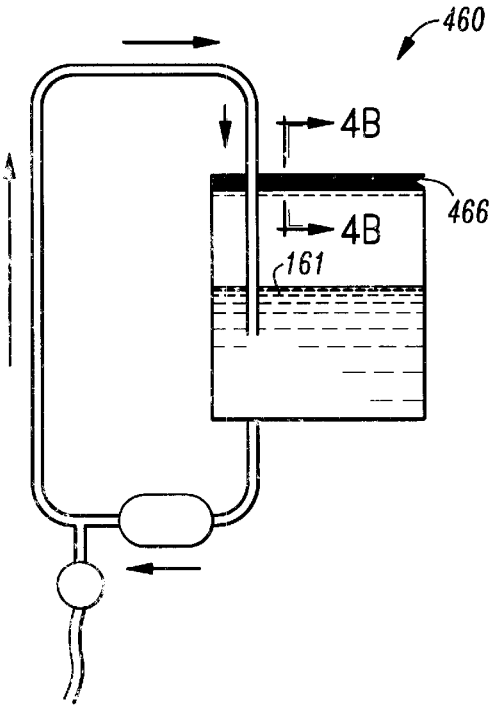
FIG. 4A illustrates a schematic view of an alternative embodiment of the slurry tank and slurry conduit of FIGS. 3A and 3B.
Figure 4B:
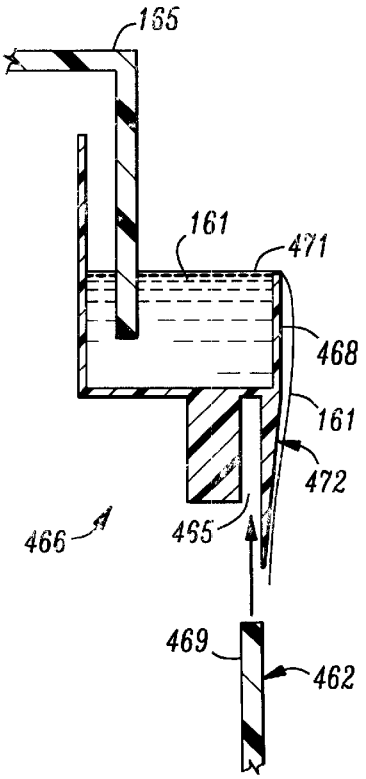
FIG. 4B illustrates an exploded, partial sectional view of the alternative embodiment of FIGS. 3A and 3B.

Referring now to FIGS. 4A and 4B, illustrated are schematic and exploded, partial sectional views of an alternative embodiment of the slurry tank and slurry conduit of FIGS. 3A and 3B. In this embodiment, a slurry conduit 466 is configured to be removably couplable to a slurry tank wall 469. As can be seen, the slurry conduit 466 has a recess 465 into which the slurry tank wall 469 is received. The slurry conduit 466 also has an internal contour 472 that smoothly transitions from an inner flange 468 to the tank wall 469. Of course, one may also readily form the conduit 466 and slurry tank 462 integrally. The exact relationship, e.g., on, inside, outside, etc., of the slurry conduit 466 to the slurry tank wall 469 is not critical as long as an essentially continuous flow of slurry 161 is maintained during operation. As slurry 161 is recirculated back to the slurry conduit 466, a slurry level 471 rises until it exceeds a height of an inner flange 468 of the slurry conduit 466. Taking advantage of the viscosity of the slurry 161 and gravity, slurry 161 flows over the inner flange 468 and follows an internal contour of the conduit 466 until the slurry 161 flows down the inside wall 469 of the slurry tank 462.

Thus, a slurry delivery system has been described that inhibits slurry drying and flaking on the inner wall of the slurry tank due to changes in slurry level. The invention may comprise a removable conduit of various configurations or be integrally molded with the slurry tank to smoothly transition return slurry back into the slurry tank.

Although the present invention has been described in detail, those skilled in the art should understand that they can make various changes, substitutions and alterations herein without departing from the spirit and scope of the invention in its broadest form.

What is claimed is:

1. For use with a slurry tank having an immersed portion and a void portion separated by a dynamic slurry surface level, a slurry delivery system, comprising:

a slurry conduit removably coupled to an inner wall of the slurry tank and configured to receive a slurry therein, the conduit further configured to deliver a stream of the slurry against a substantial portion of the inner wall in the void portion of the slurry tank.

2. The slurry delivery system as recited in claim 1 further comprising perforations in the slurry conduit, the perforations configured to deliver the stream.

3. The slurry delivery system as recited in claim 2 further comprising nozzles coupled to the conduit at the perforations and configured to deliver the stream.

4. The slurry delivery system as recited in claim 1 wherein the conduit comprises a channel having outer and inner flanges, the outer flange having a height greater than a height of the inner flange, the inner flange forming a weir against the slurry.

5. The slurry delivery system as recited in claim 4 wherein a surface of the inner flange is contoured to transition smoothly to the inner wall.

6. The slurry delivery system as recited in claim 1 wherein the slurry conduit and the tank are integrally formed.

7. The slurry delivery system as recited in claim 1 wherein the slurry conduit comprises plastic.

8. A method of manufacturing a slurry delivery system, comprising:

providing a slurry tank having an immersed portion and a void portion separated by a dynamic slurry surface lever;

providing a slurry conduit configured to receive a slurry therein; and removably coupling the slurry conduit to an inner wall of the slurry tank, the slurry conduit further configured to deliver a stream of the slurry against a substantial portion of the inner wall in the void portion of the slurry tank.

9. The method as recited in claim 8 further comprising forming perforations in the slurry conduit, the perforations configured to deliver the stream.

10. The method as recited in claim 9 further comprising coupling nozzles to the conduit at the perforations, the nozzles configured to deliver the stream.

11. The method as recited in claim 8 wherein forming a slurry conduit includes forming a channel having outer and inner flanges, the outer flange having a height greater than a height of the inner flange, the inner flange forming a weir against the slurry.

12. The method as recited in claim 11 wherein forming a channel includes contouring a surface of the inner flange to transition smoothly to the inner wall.

13. The method as recited in claim 8 wherein forming includes integrally forming the slurry conduit and the slurry tank.

14. The method as recited in claim 8 wherein forming includes forming a slurry conduit comprising plastic.

15. A polishing system, comprising:

a rotatable polishing platen;

a slurry delivery system configured to deliver a slurry to the polishing platen, the slurry delivery system including a slurry tank in fluid connection with at least one slurry transfer line and having an immersed portion and a void portion separated by a dynamic slurry surface level; and a slurry conduit removably coupled to an inner wall of the slurry tank and in fluid connection with the at least one slurry transfer line and configured to deliver a stream of the slurry against a substantial portion of the inner wall in the void portion of the slurry tank.

16. The polishing system as recited in claim 15 further comprising perforations in the slurry conduit, the perforations configured to deliver the stream.

17. The polishing system as recited in claim 16 further comprising nozzles coupled to the conduit at the perforations and configured to deliver the stream.

18. The polishing system as recited in claim 15 wherein the conduit comprises a channel having outer and inner flanges, the outer flange having a height greater than a height of the inner flange, the inner flange forming a weir against the slurry.

19. The polishing system as recited in claim 18 wherein a surface of the inner flange is contoured to engage the inner wall.

20. The polishing system as recited in claim 15 wherein the slurry conduit and the tank are integrally formed.

21. The polishing system as recited in claim 15 wherein the slurry conduit comprises plastic.

22. The polishing system as recited in claim 15 further comprising a rotatable carrier head configured to retain an object to be polished therein and engageable against the platen.

23. The polishing system as recited in claim 15 wherein the slurry delivery system further includes a pump and a slurry system conduit in fluid connection with the pump and the slurry tank.

24. A method of polishing a semiconductor wafer with a polishing apparatus having a carrier head, a polishing platen and a slurry delivery system having a slurry tank in fluid connection with at least one slurry transfer line and having an immersed portion and a void portion separated by a dynamic slurry surface level, comprising:

retaining the semiconductor wafer within the carrier head;

circulating a polishing slurry within a slurry conduit removably coupled to an inner wall of the slurry tank and in fluid connection with the at least one slurry transfer line, the conduit further configured to deliver a stream of the slurry against a substantial portion of the inner wall in the void portion of the slurry tank;

delivering polishing slurry to the polishing platen with the slurry delivery system; and polishing a substrate of the semiconductor wafer against the polishing platen with the polishing slurry.

25. The method as recited in claim 24 wherein circulating includes circulating a quantity of polishing slurry within a slurry conduit includes passing the slurry through perforations in the slurry conduit, the perforations configured to deliver the stream.

26. The method as recited in claim 25 wherein passing the slurry through perforations includes passing the slurry through nozzles coupled to the slurry conduit at the perforations.

27. The method as recited in claim 24 wherein circulating includes circulating a quantity of polishing slurry within a slurry conduit includes circulating the quantity of polishing slurry through a channel having outer and inner flanges, the outer flange having a height greater than a height of the inner flange, the inner flange forming a weir against the slurry.

28. The method as recited in claim 24 wherein circulating includes circulating a quantity of polishing slurry in the slurry conduit, the slurry conduit and the tank being integrally formed.

29. The method as recited in claim 24 wherein circulating includes circulating a quantity of polishing slurry in a slurry conduit comprising plastic.

* * * * *